US012677970B1

(12) United States Patent
Gillette

(10) Patent No.: US 12,677,970 B1
(45) Date of Patent: Jul. 14, 2026

(54) GARMENT HANGER

(71) Applicant: George R. Gillette, Arlington, VA (US)

(72) Inventor: George R. Gillette, Arlington, VA (US)

( * ) Notice: Subject to any disclaimer, the term of this patent is extended or adjusted under 35 U.S.C. 154(b) by 0 days.

(21) Appl. No.: 19/059,576

(22) Filed: Feb. 21, 2025

(51) Int. Cl.
*A47G 25/18* (2006.01)
*A47G 25/50* (2006.01)

(52) U.S. Cl.
CPC ..... *A47G 25/18* (2013.01); *A47G 25/50* (2013.01)

(58) Field of Classification Search
CPC ..... A47G 25/18; A47G 25/488; A47G 25/50
See application file for complete search history.

(56) References Cited

U.S. PATENT DOCUMENTS 2,192,167 A * 3/1940 Bagley et al. ..... A47G 25/18 211/113
2,287,473 A * 6/1942 Glines ..... A47G 25/18 211/113
3,133,643 A * 5/1964 Lester ..... A47G 25/746 211/116
D226,299 S * 2/1973 Gielow ..... D6/327
5,405,065 A * 4/1995 Olson ..... D06F 57/125 223/89
5,480,075 A * 1/1996 Robinson ..... A47G 25/16 211/115
D435,174 S * 12/2000 Grisdale ..... D6/327
6,758,378 B2 * 7/2004 Carmichael ..... A47G 25/16 223/94
8,397,961 B2 * 3/2013 Viehe ..... A47F 7/19 211/85.3
9,326,629 B2 * 5/2016 Elstein ..... A47G 25/005
D1,001,515 S * 10/2023 Li ..... D6/327
2005/0224531 A1 * 10/2005 Bulovic ..... A47G 25/48 223/85
2017/0121899 A1 * 5/2017 Oh ..... A47G 25/4023
2021/0045561 A1 * 2/2021 Manning ..... A47G 25/74
2021/0127877 A1 * 5/2021 Kim ..... A47G 25/20

FOREIGN PATENT DOCUMENTS

JP H0951997 A * 2/1997
JP 3177571 U * 8/2012
JP 3192582 U * 8/2014
JP 2016087368 A * 5/2016
KR 101186177 B1 * 10/2012 ..... D06F 57/08
KR 20170074068 A * 6/2017 ..... A23B 7/02

OTHER PUBLICATIONS

Translation KR 101186177.*
Translation JP 2016087368.*
Translation JP 3192582.*
Translation JP 3177571.*
Translation JP H0951997.*
Translation KR 20170074068.*

* cited by examiner

*Primary Examiner* — Shaun R Hurley
(74) *Attorney, Agent, or Firm* — David R. Yohannan; Yohannan Law

(57) ABSTRACT

A garment hanger has a central base extending between opposing first and second ends. A hook extends from the upper surface of the central base and wing sections are connected to the first and second ends of the central base. Rods for supporting belt loops of a garment extend substantially parallel and coextensively from the central base and wing sections.

14 Claims, 10 Drawing Sheets

GARMENT HANGER

FIELD OF THE INVENTION

One or more embodiments of the present invention relate to apparatus for hanging clothing garments from a support.

BACKGROUND OF THE INVENTION

Currently available garment hangers are not well suited for hanging items such as shorts. The most common hangers include an upper hook that is attached to a single lower horizontal bar. Shorts may be supported by a common hanger by draping them over the single horizontal bar but this may produce unwanted creases in the mid-section of the shorts. Because shorts are typically less than half the length of a pair of trousers worn by the same individual, there are little concerns about hanging shorts from the waistband. Known hangars for hanging shorts from the waistband require one or more clasps that pinch the waistband between two flat surfaces. These "clasping" hangers can be complicated to use, difficult to use depending on the thickness of the waistband, and hard to balance so that the shorts hang in a desired vertical fashion.

The present applicant has determined that it would be preferable to provide a hanger capable of supporting shorts from the belt loops located at the waistband. More specifically, the applicant has determined that a pair of shorts should be suspended by the belt loops by two parallel and coextensive rods. While there are some known hangers that include an upper hook that is attached to two open ended horizontal bars, none of these known hangers are well designed to accommodate hanging one pair of shorts, or multiple pairs of shorts, in a practical and space saving manner. For example, U.S. Pat. No. 11,426,019 discloses a hanger with two opened ended horizontal bars, but the bars are not shaped such as to easily receive the belt loops of a pair of shorts. In another example, U.S. Pat. No. 3,276,645 discloses a hanger with two parallel extensions that have large terminal ends that could not accommodate a typical belt loop.

In view of the foregoing, there is a need for a garment hanger configured to support one or more pairs of shorts from the belt loops in a manner that permits the shorts to be easily installed on, and removed from, the hanger. There is also a need to suspend one or more pairs of shorts by the belt loops using two parallel and coextensive rods. There is also a need for a hanger system that supports multiple pairs of shorts in a space efficient manner. Still further, there is a need for a hanger system that may be modified to support multiple pairs of shorts using a single upper hook.

OBJECTS OF THE INVENTION

Accordingly, it is an object of some, but not necessarily all embodiments of the present invention to provide a garment hanger configured to support one or more pairs of shorts from the belt loops in a manner that permits the shorts to be easily installed on, and removed from, the hanger.

It is also an object of some but not necessarily all embodiments of the present invention to provide a garment hanger configured to suspend one or more pairs of shorts by the belt loops using two parallel and coextensive rods. Preferably such rods may be thin and tubular so as to easily slidably receive belt loops.

It is another object of some, but not necessarily all embodiments of the present invention to provide a hanger system that supports multiple pairs of shorts in a space efficient manner.

It is yet another object of some, but not necessarily all embodiments of the present invention to provide a hanger system that may be modified to support multiple pairs of shorts using a single upper hook.

SUMMARY OF EMBODIMENTS OF THE INVENTION

Responsive to the foregoing challenges, Applicant has developed an innovative garment hanger comprising: a central base section having an upper surface and a front surface extending between a first end and a second end of the central base section; a hook extending from the central base section upper surface; a first rod and a second rod extending from the central base section front surface; a first wing section connected to the first end of the central base section; a second wing section connected to the second end of the central base section; a third rod extending from the first wing section; and a fourth rod extending from the second wing section.

Applicant has further developed an innovative garment hanger comprising: a central base section having an upper surface and a front surface extending between a first end and a second end of the central base section; a hook extending from the central base section upper surface; a first rod and a second rod extending from the central base section front surface; a first connection feature disposed at the first end; and a second connection feature disposed at the second end, wherein the first and second connection features are configured to engage mating connection features provided with corresponding first and second wing sections.

Applicant has still further developed an innovative garment hanger comprising: a central base section having an upper surface and a front surface extending between a first end and a second end of the central base section; a hook extending from the central base section upper surface; a first rod and a second rod extending from the central base section front surface; a first wing section integrally formed at the first end of the central base section; a second wing section integrally formed at the second end of the central base section; a third rod extending from the first wing section; and a fourth rod extending from the second wing section.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements. The drawings are exemplary only and should not be construed as limiting the invention.

DETAILED DESCRIPTION OF EMBODIMENTS OF THE INVENTION

Figure 1:
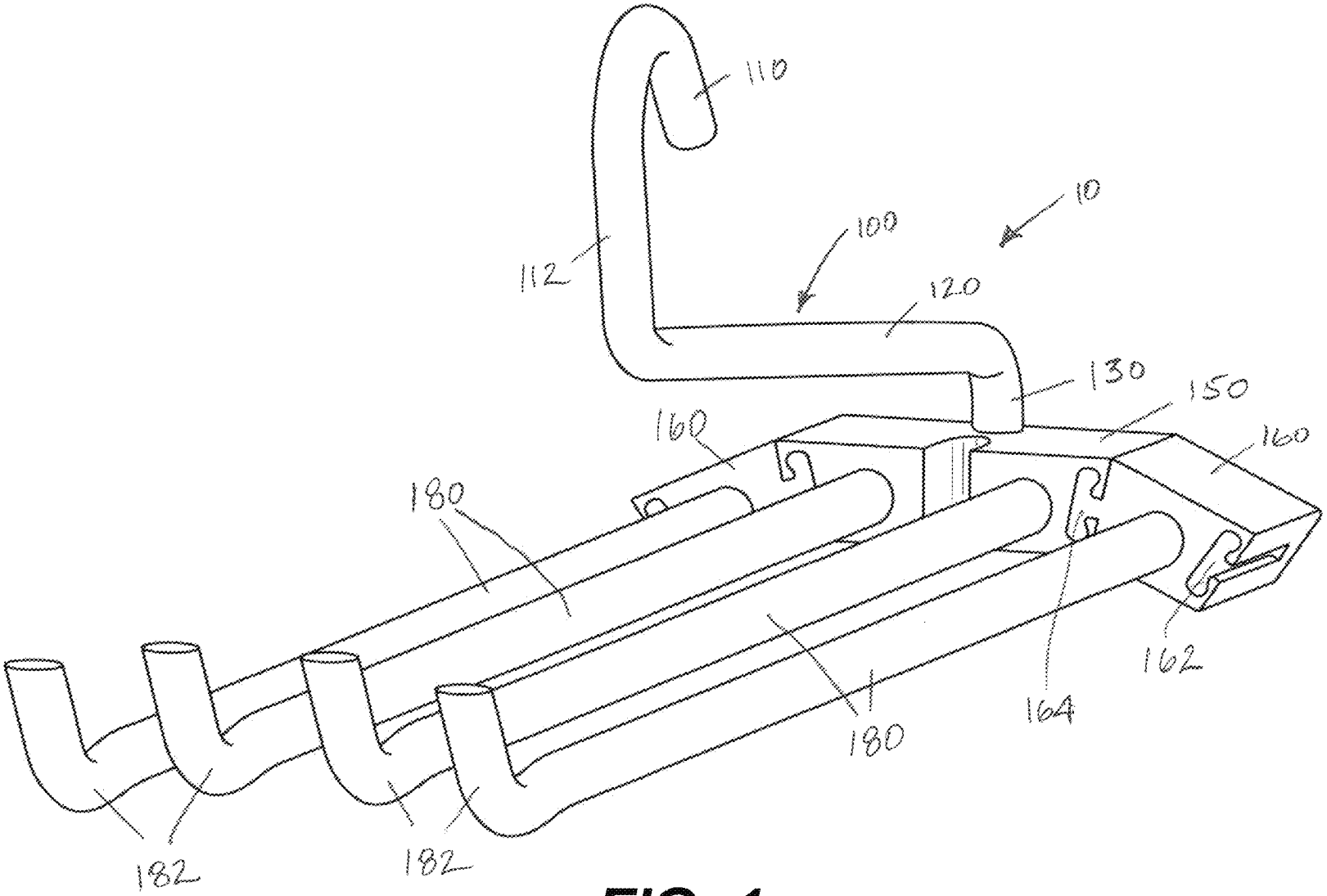
FIG. 1 is a pictorial front view of a garment hanger including a central base section and two connected wing sections in accordance with a first embodiment of the invention.
Figure 2:
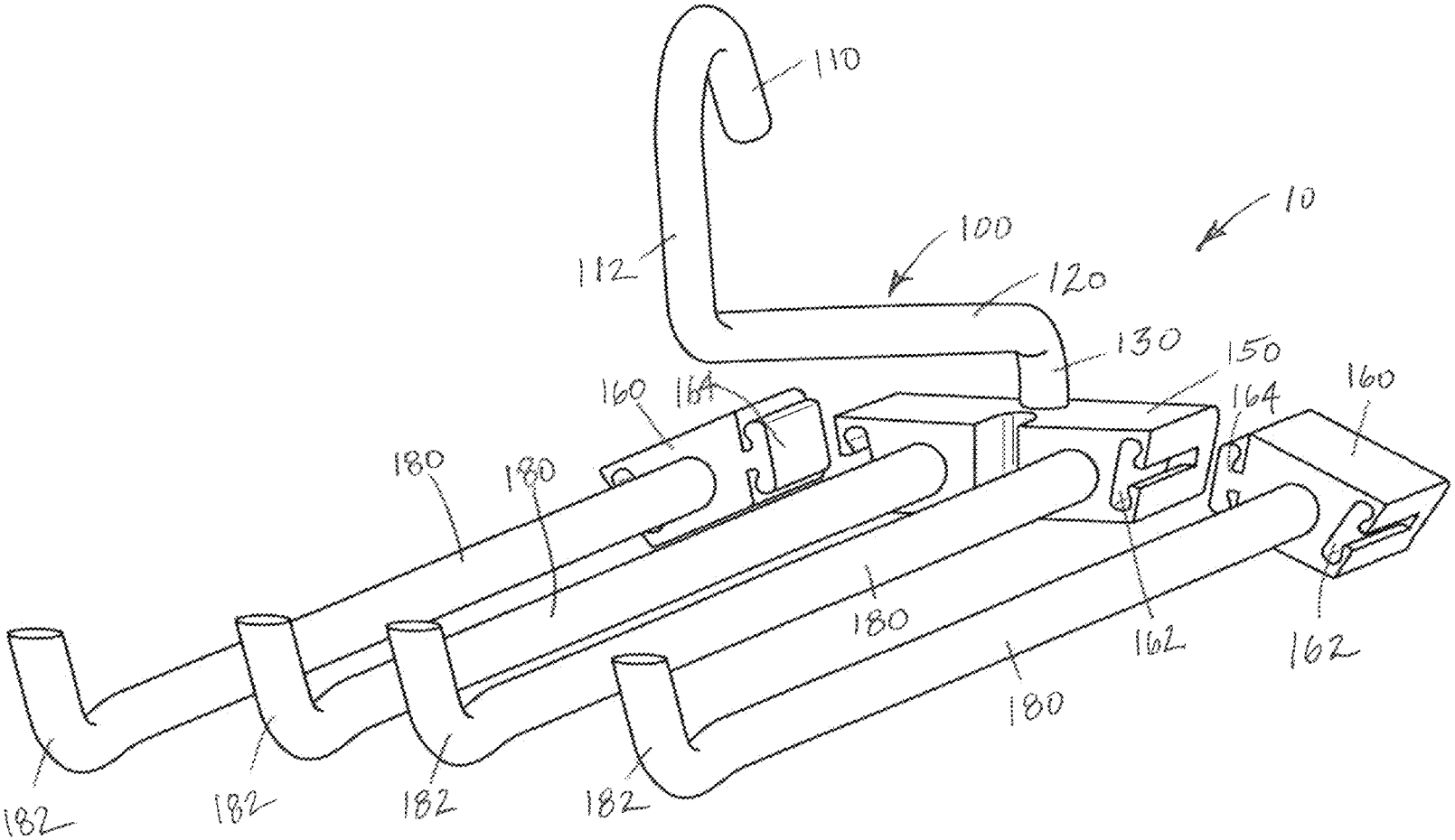
FIG. 2 is an exploded pictorial front view of a garment hanger including a central base section and two wing sections in accordance with the first embodiment of the invention.
Figure 3:
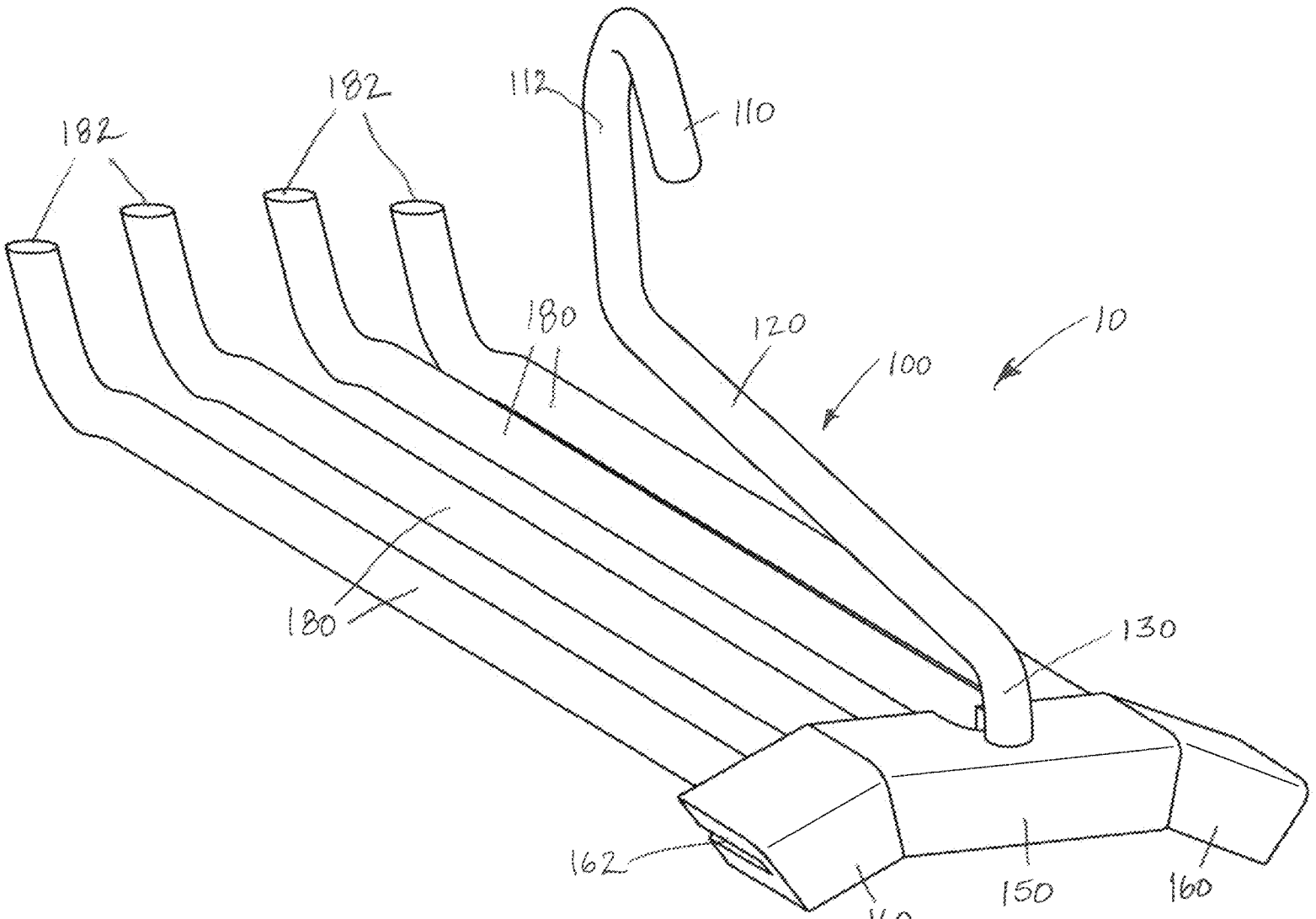
FIG. 3 is a pictorial back view of a garment hanger including a central base section and two connected wing sections in accordance with the first embodiment of the invention.
Figure 4:
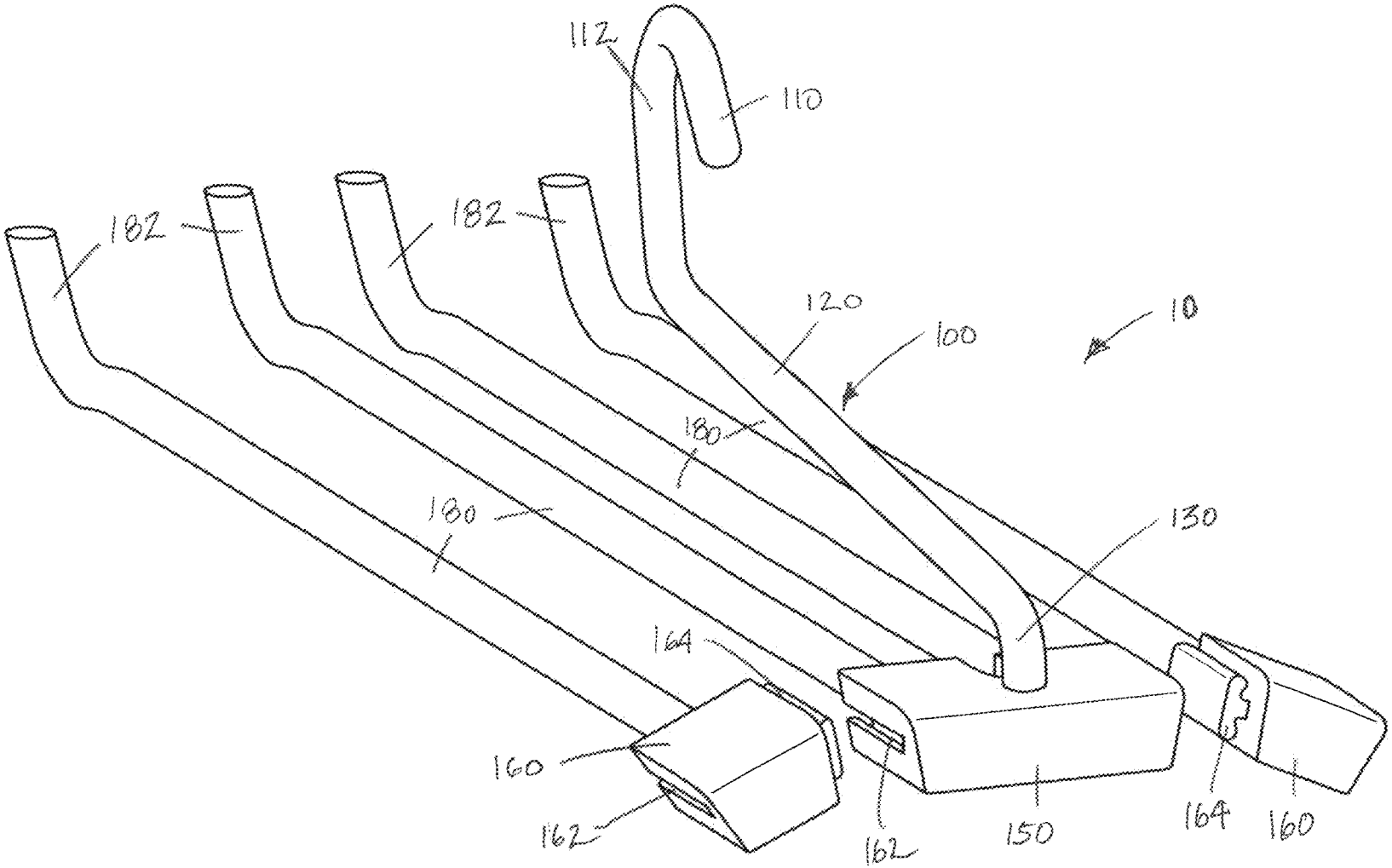
FIG. 4 is an exploded pictorial back view of a garment hanger including a central base section and two wing sections in accordance with the first embodiment of the invention.
Figure 5:
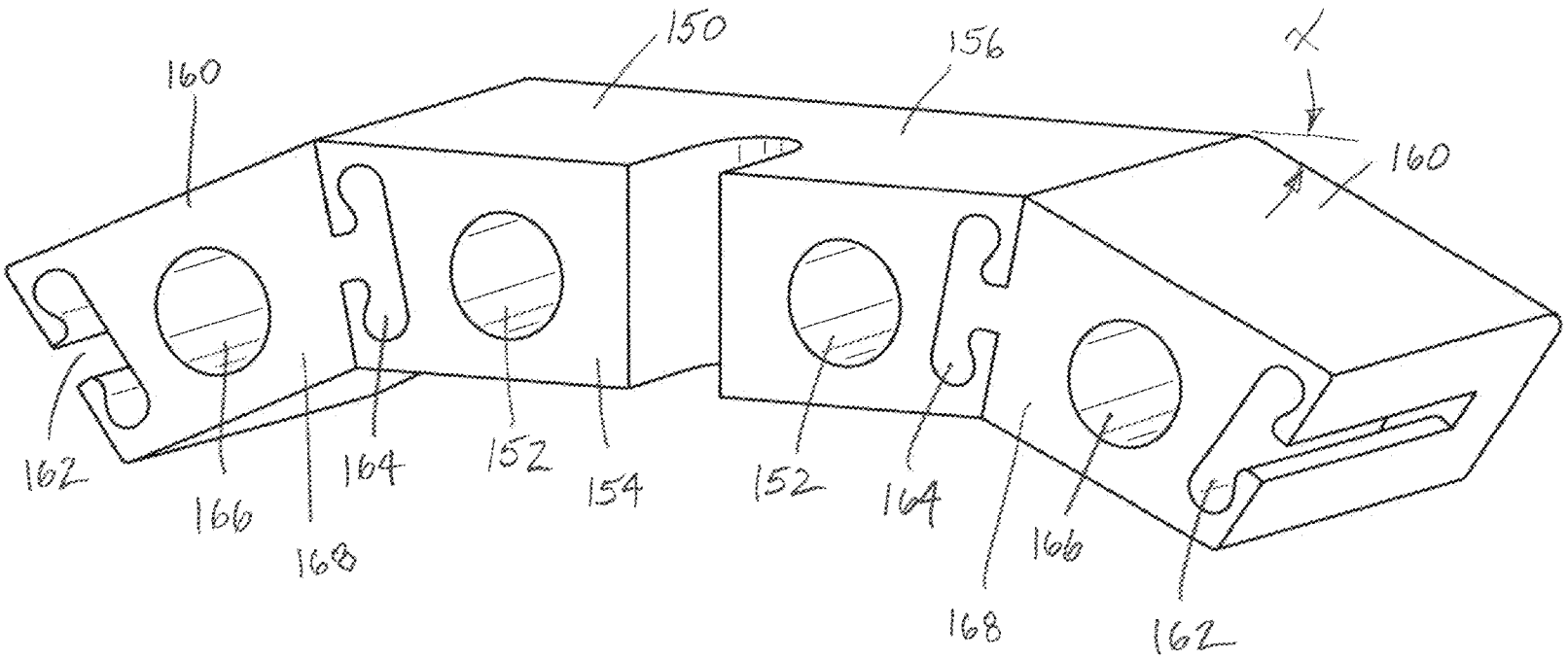
FIG. 5 is a detailed pictorial view of the central base section and connected wing sections of a garment hanger in accordance with the first embodiment of the invention.

Reference will now be made in detail to embodiments of the present invention, examples of which are illustrated in the accompanying drawings. With reference to FIGS. 1-5, a first embodiment of the garment hanger 10 is illustrated. The garment hanger 10 may include elements made of metal, plastics or composite materials. The garment hanger 10 may include an elongated central base section 150 having an upper surface 156 and a front surface 154 extending between a first side end and a second side end of the central base section. Bores 152 may be formed in the central base section 150 front surface 154. The bores 152 may be configured to receive the ends of rods 180, discussed below. A connection feature, such as a male or female feature, including without limitation a male dovetail feature 164 or a female dovetail feature 162, may be formed in or at the first and second side ends of the central base section 150.

First and second wing sections 160 may each have a connection feature 162/164 formed in or at first and second opposing ends of the wing section. The connection feature 162/164 of the first and second wing sections 160 may be configured to mate with an adjacent connection feature formed in or at the first and second side ends of the central base section 150. Each of the first and second wing sections 160 may include a bore 166 extending inward from the front face 168 of the wing section. The bores 166 may be configured to receive the ends of rods 180, discussed below. The first and second wing sections 160 may be removably connected to the central base section 150 via the connection features such as but not limited to male and female dovetail connections 162/164.

A first rod 180 and a second rod 180 may extend from the bores 152 formed in the central base section 150 front surface 154. A third rod 180 may extend from a bore 166 formed in the first wing section 160; and a fourth rod 180 may extend from a bore 166 formed in the second wing section 160. Each of the first, second, third and fourth rods 180 may include an upward angled tip 182 having a rounded lower elbow configured to easily receive a garment belt loop. The length of the rods 180 may be such that the half or more of the belt loops of a garment may be supported and spread out along the rods without bunching or wrinkling of the garment.

A hook 100 may extend upward and away from the central base section 150 upper surface 156. The hook 100 may have a base 130 attached to a central upper portion of the central base section 150. The base 130 may be inserted into a mating bore by press fit, or alternatively adhered to the upper surface 156 or in the bore with an adhesive, glue, or cement. The base 130 of the hook 100 may be integrally formed with a transverse section 120 that extends slightly upward and away from the base 130 in a direction substantially parallel to the longitudinal dimension of the rods 180. The hook 100 may further include an inverted J shaped portion that includes a neck 112 extending upward from the upper most end of the transverse section 120 and a curved tip 110 extending from the neck 112. The inverted J shaped portion neck 112 and curved tip 110 may be configured to support the garment hanger 100 on a horizontal member (not shown) such as a closet clothes hanger bar.

The central base section 150 may have a first central longitudinal axis; and the first wing section 160 may have a second central longitudinal axis. The first central longitudinal axis of the central base section 150 and the second central longitudinal axis of the first wing section 160 intersect at an angle X greater than zero degrees. Similarly, the second wing section 160 may have a third central longitudinal axis wherein the first central longitudinal axis of the central base section 150 and the third central longitudinal axis of the second wing section 160 intersect at an angle X greater than zero degrees.

Optionally, the outermost surface of the first wing section 160 may include a connection feature 162/164 configured to connect to a third wing section 160, and the outermost surface of the second wing section may include a connection feature 162/164 configured to connect to a fourth wing section. The third and fourth wing sections may each have one or two rods extending therefrom enabling the garment hanger to support additional garments.

Figure 6:
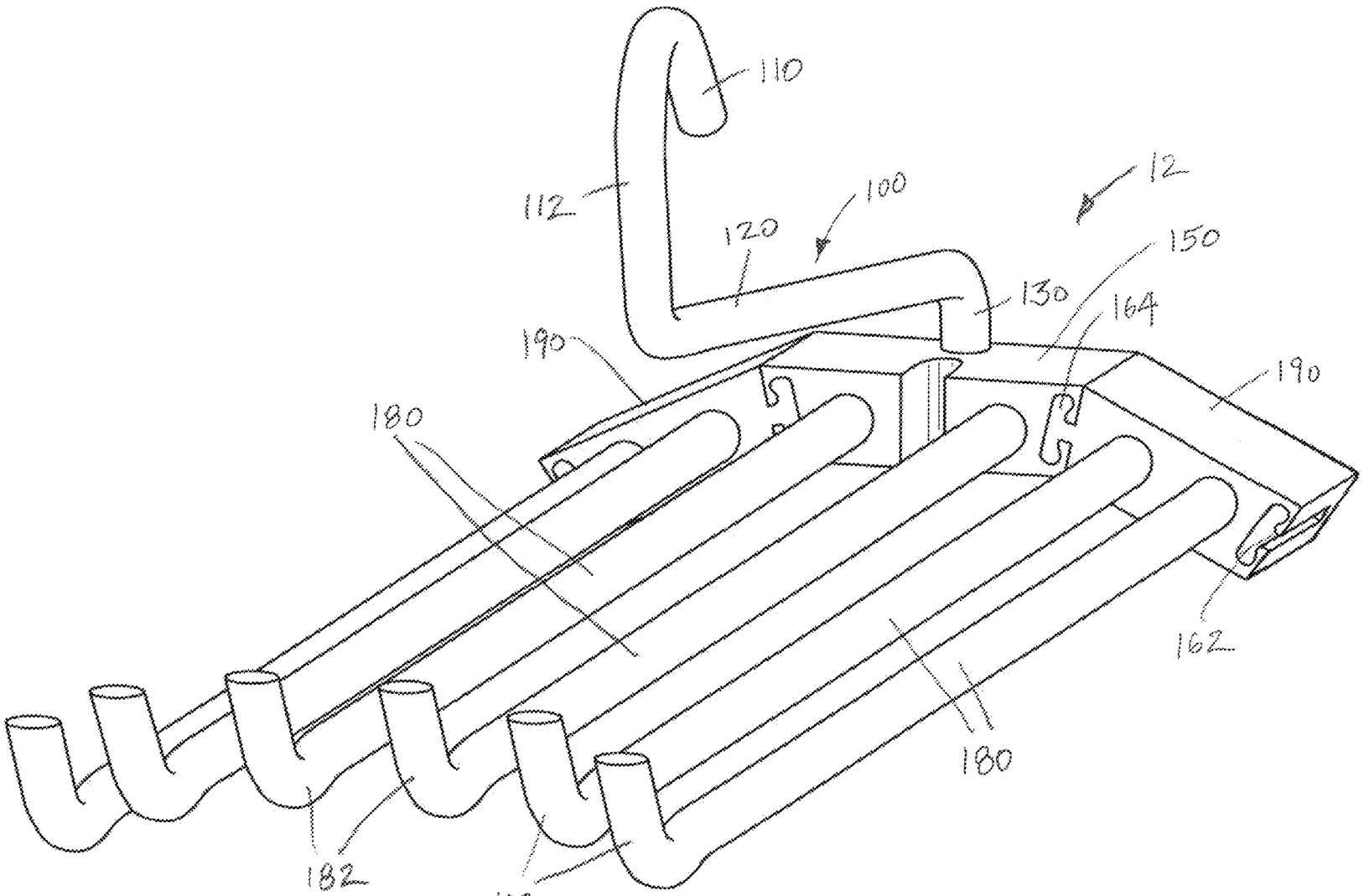
FIG. 6 is a pictorial front view of a garment hanger including a central base section and two connected alternative wing sections in accordance with a second embodiment of the invention.
Figure 7:
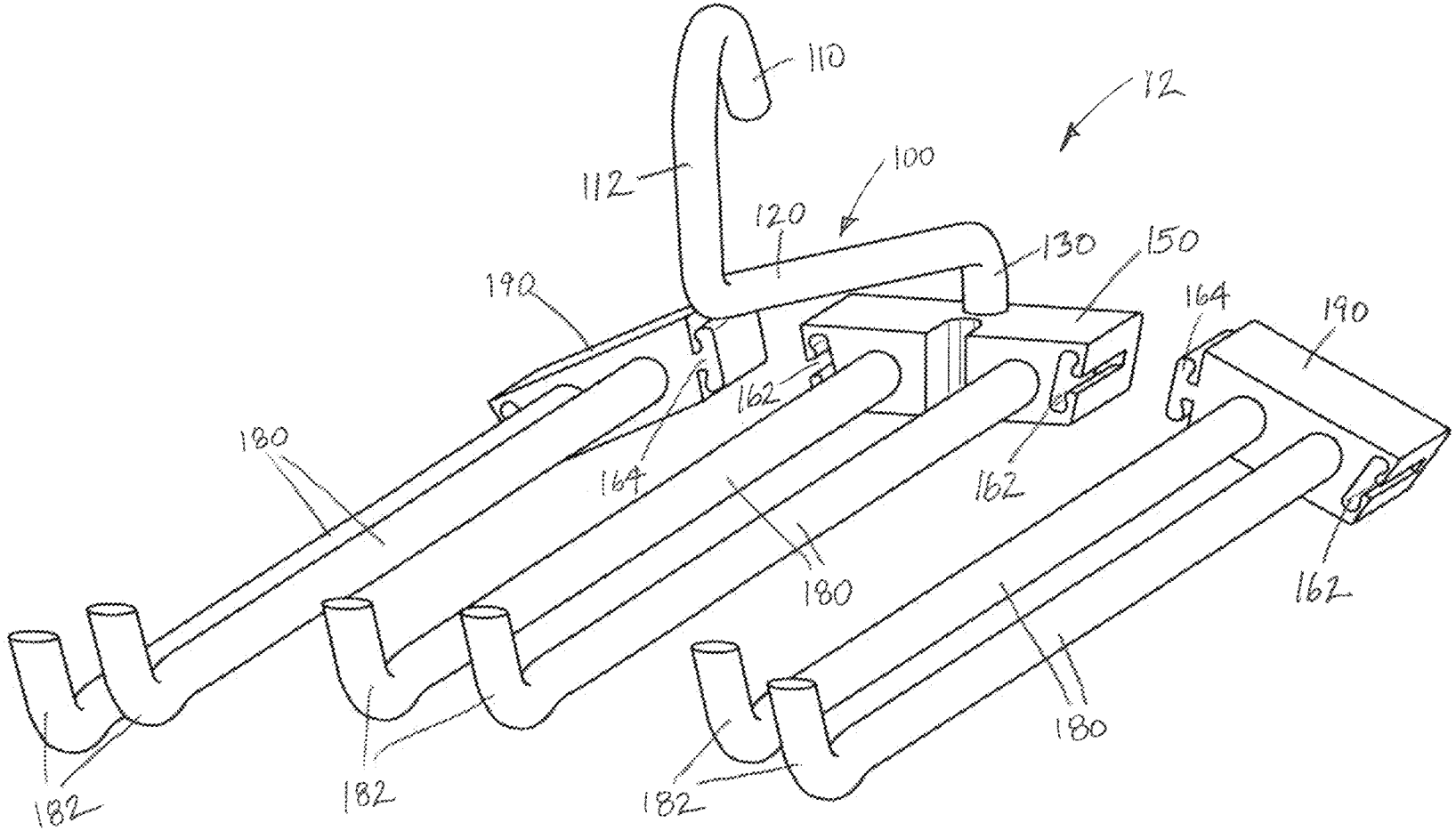
FIG. 7 is an exploded pictorial front view of a garment hanger including a central base section and two alternative wing sections in accordance with the second embodiment of the invention.
Figure 8:
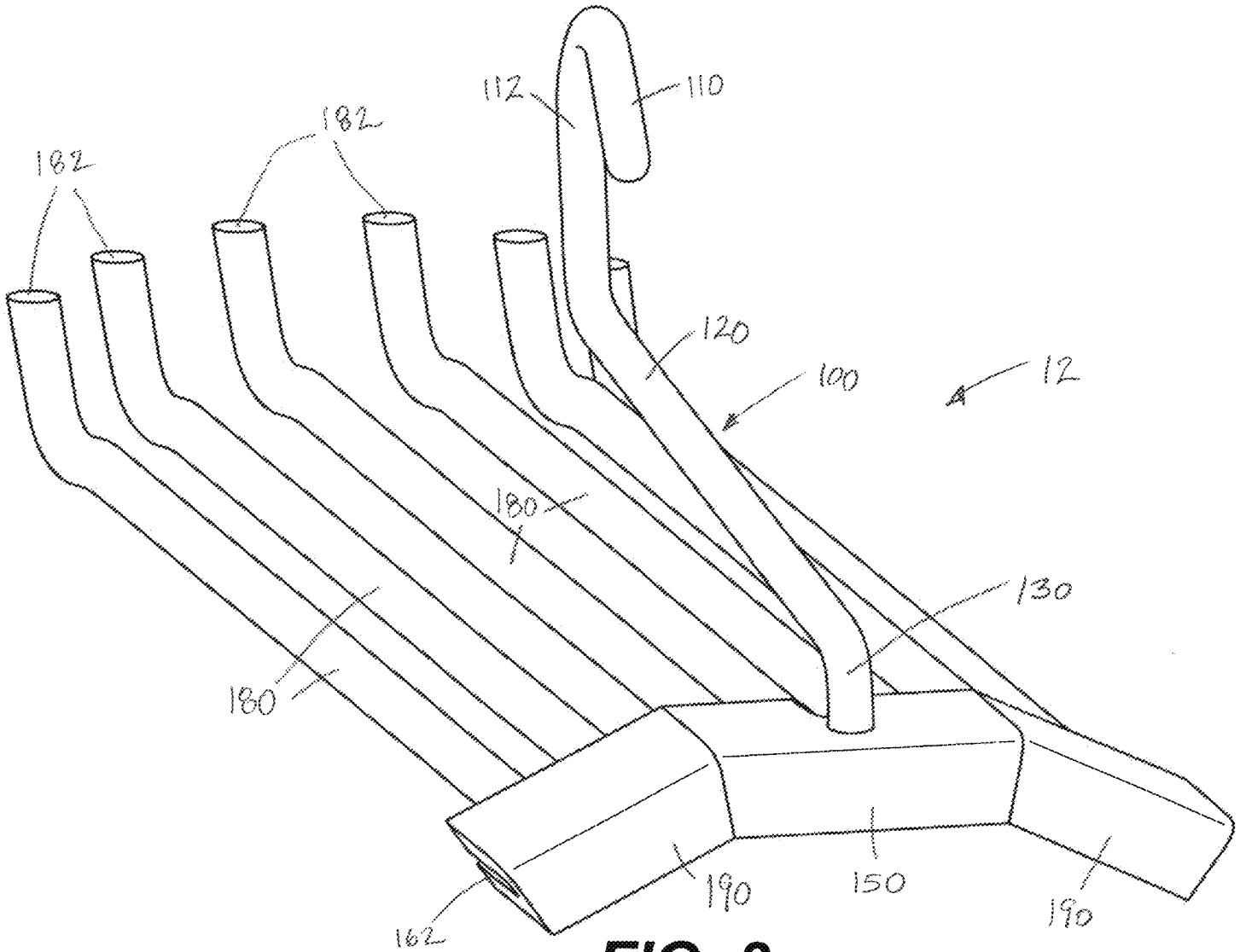
FIG. 8 is a pictorial back view of a garment hanger including a central base section and two connected alternative wing sections in accordance with the second embodiment of the invention.
Figure 9:
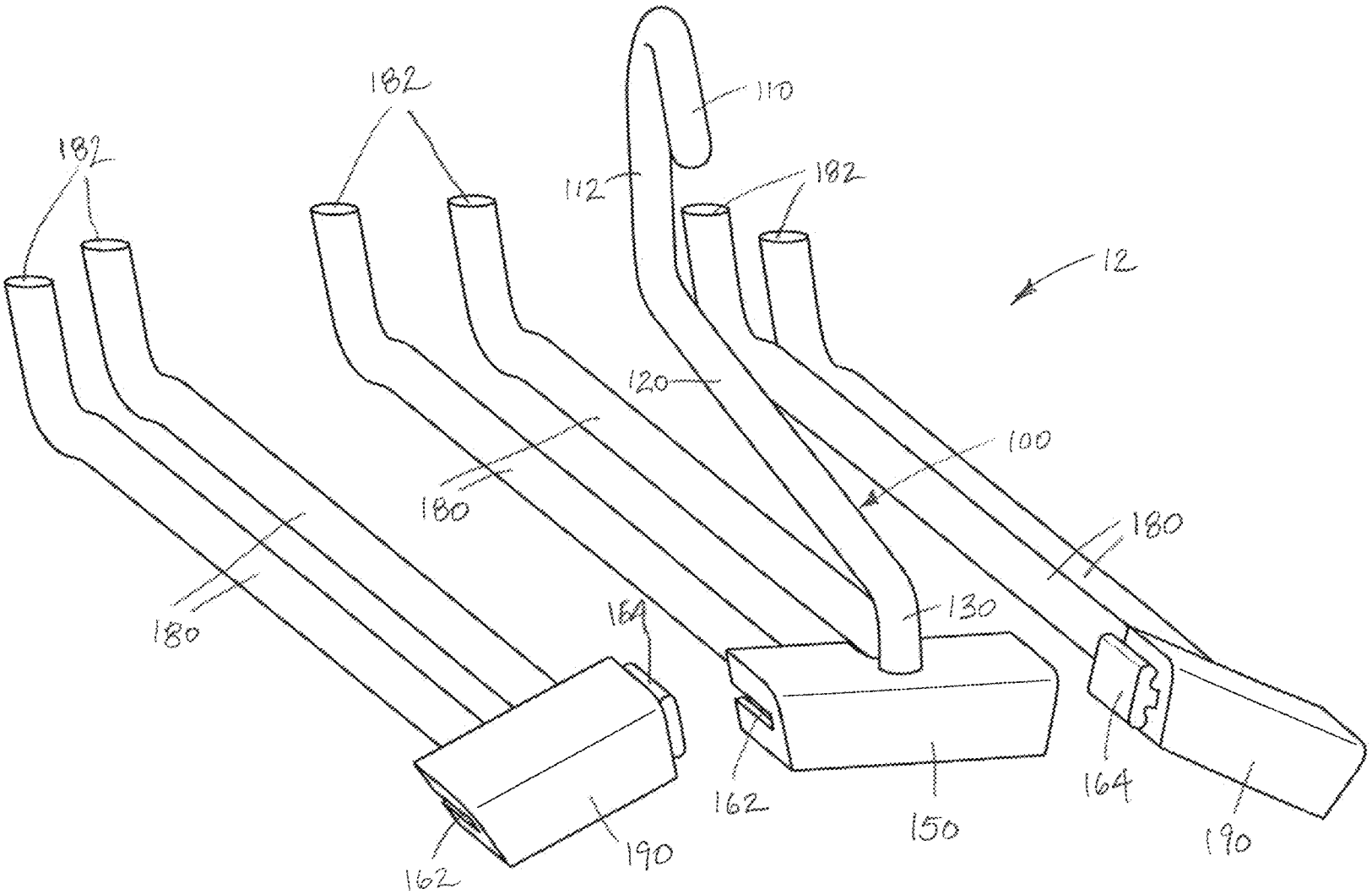
FIG. 9 is an exploded pictorial back view of a garment hanger including a central base section and two alternative wing sections in accordance with the second embodiment of the invention.
Figure 10:
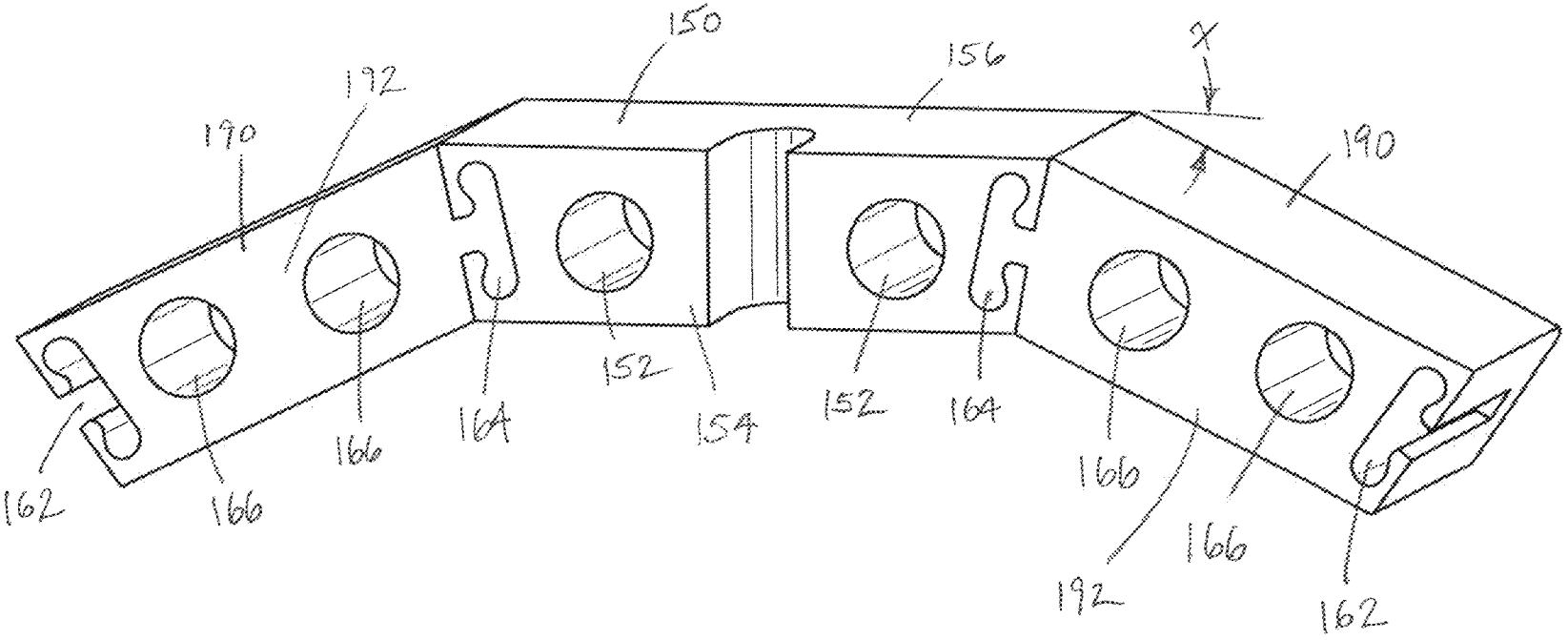
FIG. 10 is a detailed pictorial view of the central base section and connected alternative wing sections of a garment hanger in accordance with the second embodiment of the invention.

A second embodiment of the present invention garment hanger 12 is illustrated in FIGS. 6-9. With reference to FIGS. 6-9 in which like reference characters refer to like elements to those shown in FIGS. 1-5, the garment hanger 12 may include first and second wing sections 190 have a front surface 192 in which two bores 166 extend inward into each of the first and second wing sections. Each of the two bores 166 may be configured to receive the ends of first and second rods 180. As a result of the inclusion of two rods 180 per wing section 190, the second embodiment garment hanger 12 may support more garments as compared with the first garment hanger 10. In all other respects, the garment hanger 12 is like garment hanger 10.

As will be understood by those skilled in the art, the invention may be embodied in other specific forms without departing from the spirit or essential characteristics thereof. The elements described above are provided as illustrative examples for implementing the invention. One skilled in the art will recognize that many other implementations are possible without departing from the present invention as recited in the claims. For example, the shapes and sizes of various elements of the embodiments of the invention may be changed without departing from the intended scope of the invention. Accordingly, the disclosure of the present invention is intended to be illustrative, but not limiting, of the scope of the invention. It is intended that the present invention cover all such modifications and variations of the invention, provided they come within the scope of the appended claims and their equivalents.

What is claimed is:

1. A garment hanger comprising:

a central base section having an upper surface and a front surface extending between a first end and a second end of the central base section;

a hook extending from the central base section upper surface;

a first rod and a second rod extending from the central base section front surface;

a first wing section connected to the first end of the central base section;

a second wing section connected to the second end of the central base section;

a third rod extending from the first wing section; and a fourth rod extending from the second wing section, wherein the first wing section includes a connection feature configured to connect to a third wing section, and wherein the second wing section includes a connection feature configured to connect to a fourth wing section.

2. The garment hanger of claim 1 wherein the first wing section and the second wing section are removably connected to the central base section.

3. The garment hanger of claim 2 wherein the central base section has a first central longitudinal axis and the first wing section has a second central longitudinal axis, and wherein the first central longitudinal axis and the second central longitudinal axis intersect at an angle greater than zero degrees.

4. The garment hanger of claim 1 wherein the first wing section and the second wing section are removably connected to the central base section via dovetail connections.

5. The garment hanger of claim 4 wherein the central base section has a first central longitudinal axis and the first wing section has a second central longitudinal axis, and wherein the first central longitudinal axis and the second central longitudinal axis intersect at an angle greater than zero degrees.

6. The garment hanger of claim 1 further comprising:

a fifth rod extending from the first wing section; and a sixth rod extending from the second wing section.

7. The garment hanger of claim 6 wherein the central base section has a first central longitudinal axis and the first wing section has a second central longitudinal axis, and wherein the first central longitudinal axis and the second central longitudinal axis intersect at an angle greater than zero degrees.

8. The garment hanger of claim 6 wherein the first wing section and the second wing section are removably connected to the central base section.

9. The garment hanger of claim 8 wherein the central base section has a first central longitudinal axis and the first wing section has a second central longitudinal axis, and wherein the first central longitudinal axis and the second central longitudinal axis intersect at an angle greater than zero degrees.

10. The garment hanger of claim 6 wherein the first wing section and the second wing section are removably connected to the central base section via dovetail connections.

11. The garment hanger of claim 10 wherein the central base section has a first central longitudinal axis and the first wing section has a second central longitudinal axis, and wherein the first central longitudinal axis and the second central longitudinal axis intersect at an angle greater than zero degrees.

12. A garment hanger comprising:

a central base section having an upper surface and a front surface extending between a first end and a second end of the central base section;

a hook extending from the central base section upper surface;

a first rod and a second rod extending from the central base section front surface;

a first wing section connected to the first end of the central base section;

a second wing section connected to the second end of the central base section;

a third rod extending from the first wing section; and a fourth rod extending from the second wing section, wherein the central base section has a first central longitudinal axis and the first wing section has a second central longitudinal axis, and wherein the first central longitudinal axis and the second central longitudinal axis intersect at an angle greater than zero degrees.

13. A garment hanger comprising:

a central base section having an upper surface and a front surface extending between a first end and a second end of the central base section;

a hook extending from the central base section upper surface;

a first rod and a second rod extending from the central base section front surface;

a first wing section integrally formed at the first end of the central base section;

a second wing section integrally formed at the second end of the central base section;

a third rod extending from the first wing section; and a fourth rod extending from the second wing section, wherein the central base section has a first central longitudinal axis and the first wing section has a second central longitudinal axis, and wherein the first central longitudinal axis and the second central longitudinal axis intersect at an angle greater than zero degrees.

14. The garment hanger of claim 13 further comprising:

a fifth rod extending from the first wing section; and a sixth rod extending from the second wing section.

* * * * *